US007000798B2

(12) United States Patent
Gruennert et al.

(10) Patent No.: US 7,000,798 B2
(45) Date of Patent: Feb. 21, 2006

(54) ROTATING LAUNDRY STORAGE

(76) Inventors: Robert Gruennert, 468 Wabbash Ter., Port Charlotte, FL (US) 33954; Lance Messmer, 6934 Munsee La., Indianapolis, IN (US) 46260

( * ) Notice: Subject to any disclaimer, the term of this patent is extended or adjusted under 35 U.S.C. 154(b) by 353 days.

(21) Appl. No.: 10/666,030

(22) Filed: Sep. 19, 2003

(65) Prior Publication Data

US 2004/0069787 A1 Apr. 15, 2004

Related U.S. Application Data

(60) Provisional application No. 60/414,072, filed on Sep. 27, 2002.

(51) Int. Cl.
*B65D 90/00* (2006.01)

(52) U.S. Cl. ..... 220/495.09; 220/628; 220/503; 312/285; 312/249.2

(58) Field of Classification Search ..... 220/495.09, 220/628, 630, 631, 636, 495.06, 495.05; 312/283, 285, 294.2
See application file for complete search history.

(56) References Cited

U.S. PATENT DOCUMENTS

| | | | | | |
|---|---|---|---|---|---|
| 2,895,782 | A | * | 7/1959 | Fragale | 312/290 |
| 3,958,715 | A | | 5/1976 | Capelli | |
| 4,057,309 | A | | 11/1977 | Fragale | |
| 4,905,853 | A | * | 3/1990 | Strawder | 220/523 |
| 5,046,635 | A | * | 9/1991 | Haas et al. | 220/524 |
| 5,320,241 | A | * | 6/1994 | Evans | 220/495.09 |
| 5,700,293 | A | | 12/1997 | Rydell | |
| 5,833,336 | A | * | 11/1998 | Dean | 312/293.2 |
| 6,062,416 | A | * | 5/2000 | Smillie | 220/524 |
| D441,928 | S | | 5/2001 | Adams | |
| 6,352,225 | B1 | | 3/2002 | Dooley et al. | |
| 6,491,264 | B1 | | 12/2002 | Valesquez | |
| 6,601,723 | B1 | | 8/2003 | Ziglar | |

* cited by examiner

*Primary Examiner*—Nathan J. Newhouse
*Assistant Examiner*—Eugene Lhymn
(74) *Attorney, Agent, or Firm*—Frank A. Lukasik

(57) ABSTRACT

A revolveable laundry hamper for individually storing laundry in a plurality of chambers into which garments and items requiring laundering can be separated according to wash cycle required. The laundry hamper consists of a box-like structure having four side doors with fasteners on each door and the underside of the structure to hold a laundry bag open. The entire structure is mounted on a turntable to be rotated to select the appropriate laundry bag for the item to be washed.

4 Claims, 3 Drawing Sheets

ROTATING LAUNDRY STORAGE

RELATED INVENTION

Applicant claims priority based on Provisional Patent Application Ser. No. 60/414,072 Filed Sep. 27, 2002.

BACKGROUND OF THE INVENTION

1. Field of the Invention

The present invention relates generally to laundry hampers, and more specifically, the present invention relates to a container for individually storing laundry in a revolveable laundry hamper having a plurality of chambers into which garments and items requiring laundering can be separated according to the type of wash cycle required or for other reasons requiring separation.

2. Description of the Prior Art

One of the more tedious household chores is the sorting and separating laundry prior to washing. Typically, all of the clothing to be laundered is stored together in a conventional clothes hamper and sorted immediately prior to washing. Thus, in present conventional hampers, the clothing items must all be manually removed, transferred and likely stored in a laundry basket or placed on the floor to sort. This greatly increases the time and effort required to wash the laundry. Clearly, there is a need for a means to sort and store laundry as it becomes soiled.

Prior art laundry hampers consist of some form of container conveniently located so that discarded clothing, etc. can be collected therein. Having only a single container requires the sorting of clothes prior to doing the laundry, this is time consuming and inconvenient and, when clothes are unpleasantly soiled, adds to the "chore" of doing laundry.

Holders for flexible laundry bags which are configured as a rigid box frame are known. Some such hampers have been designed to resemble furniture on their exterior surface, e.g., Des. 441,928 to Adams. When it is desirable to separate several items of soiled clothing according to their size, color, fabric, moisture content, etc., partitions either internally or externally of the hamper have been used. U.S. Pat. No. 5,833,336 to Dean discloses a clothes hamper apparatus having removable interior partitions and removable mesh clothing bags. Each partition has vertical edge members which are shaped to engage slots in a track system located on the hamper's walls or on another partition which it engages. Hook and loop fastener elements are located on mesh bags inserted into the hamper's interior and the walls of the partitions and the hamper to releasably retain the bag and their clothing contents in place within the hamper.

U.S. Pat. No. 3,958,715 to Capelli discloses a clothes hamper having a hollow foraminous interior partition extending lengthwise of the hamper to form a pair of compartments.

U.S. Pat. No. 4,057,309 to Fragale discloses a clothes hamper having a central horizontal partition-shelf defining an upper, open-topped compartment and a lower, open-fronted compartment, a plurality of upper, open topped, free-standing sub-containers removably mounted on the partition shelf, and a plurality of lower, open-topped, free-standing sub-containers mounted below the hamper below the partition for movement into and out of the hamper through a front wall opening.

U.S. Pat. No. 6,062,416 to Smillie discloses a hamper comprising two lower compartments for storing bulkier items and two inner compartments arranged to pivot within the container from a position wherein the inner compartment (s) are within the container to an outward position wherein the inner compartments are outward of the container. The inner compartments are arranged to accept one or more rigid inserts.

SUMMARY OF THE INVENTION

Family laundry has advanced considerably with the invention of new, electronically controlled washing machines capable of performing very specialized wash cycles. To use these machines to their full capabilities, laundry must be separated into various categories.

It is one object of the invention, therefore, to provide a clothes hamper arranged for sorting and storing items to be laundered.

It is another object is to provide a cabinet mounted upon a rotating base.

A still further object is to provide a plurality of chambers, each chamber containing a net bag removably attached to a vertically hinged door.

The present invention in either of its embodiments, as a four or eight sided unit, facilitates the collection and sorting of laundry simultaneously.

The invention is cosmetically appealing and durable and consists of a cabinet mounted upon a revolving base. This "carousel" arrangement gives access to any of the chambers within. Each chamber contains a net bag attached to the vertically hinged door. When the door is lowered into the open position, the net opens giving access for clothing to be placed inside. Sorting laundry is accomplished by rotating the unit to gain access to whatever door contains the net for a particular type of clothing. The doors each have knobs for easy movement of the doors and magnetic catches to keep the doors upright.

DETAILED DESCRIPTION OF THE INVENTION

Figure 1:
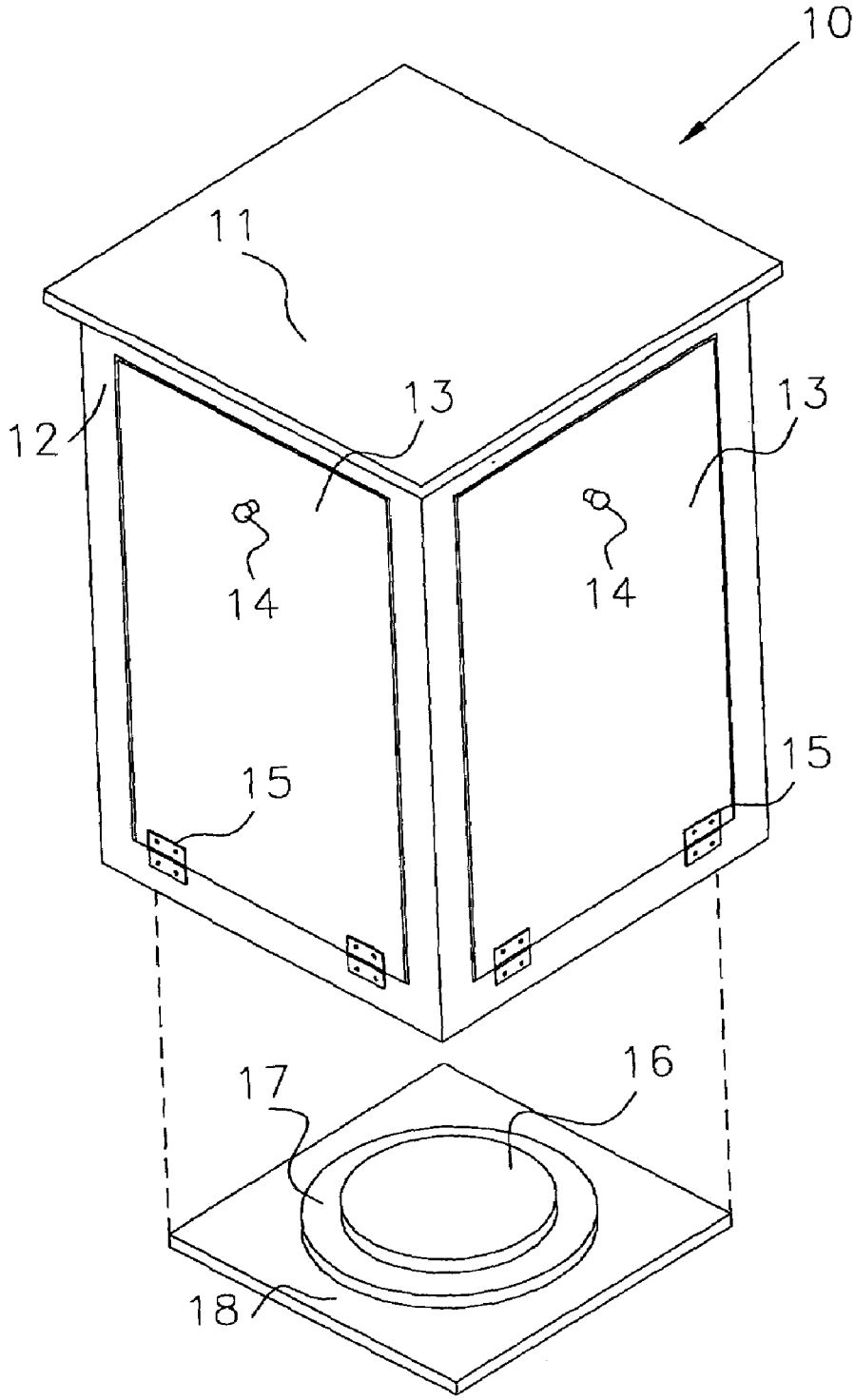
FIG. 1 is an exploded isometric view of a first embodiment of the invention described herein.
Figure 2:
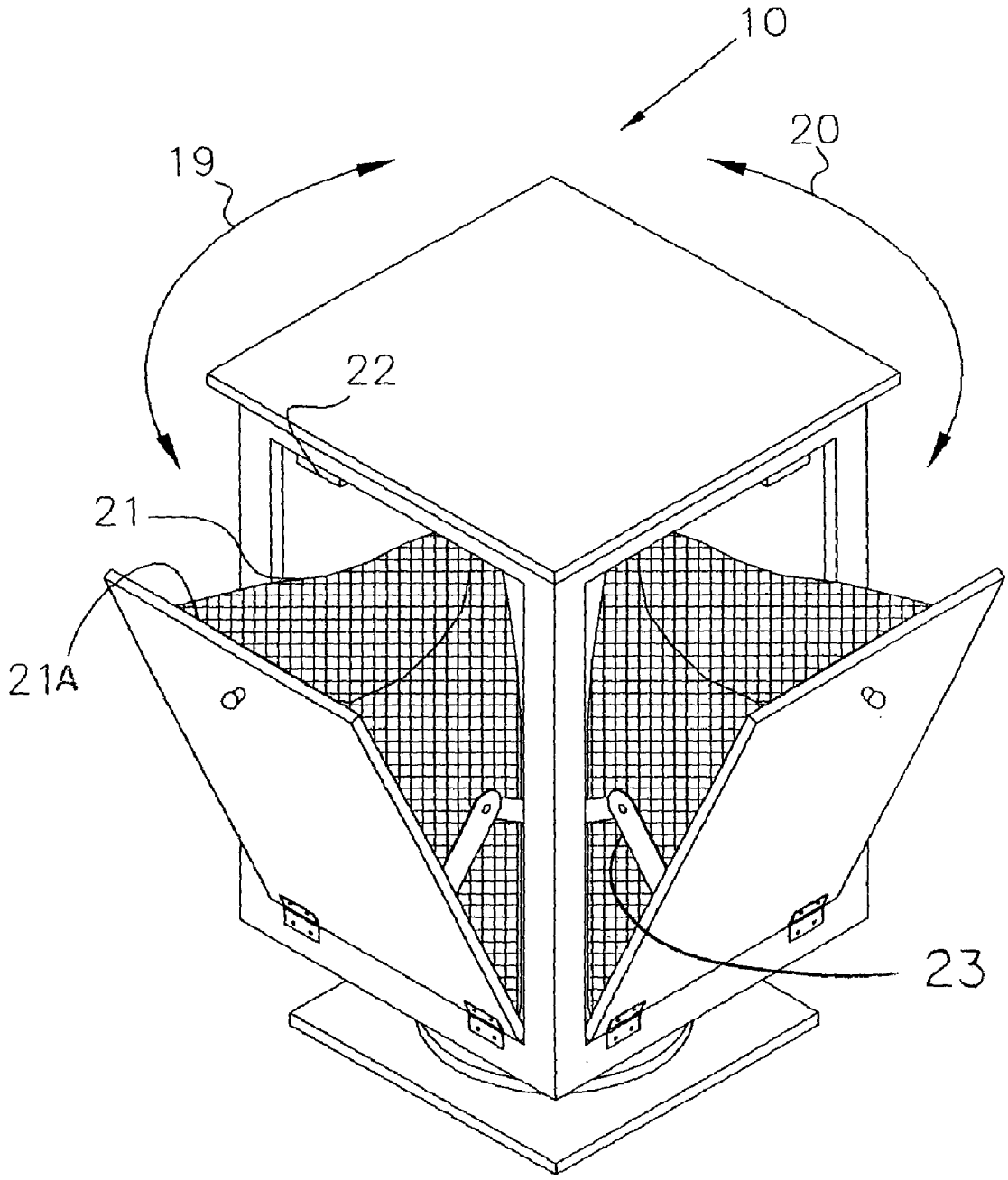
FIG. 2 is an isometric view of the invention showing the doors open as they would appear when the unit is deployed.

Referring now to the drawings in which like numerals designate like and corresponding parts throughout the several views, in FIGS. 1 and 2, the invention is designated overall by the numeral 10. The rotating laundry storage 10 comprises a box-like structure consisting of a top 11, frame 12, a base 18, a twelve inch "Lazy Susan" turntable 17, and a set of doors 13. The top 11 is supported by frame 12 into which doors 13 are fastened with hinges 15. The door is hinged at the bottom of the frame 12.

Drawer knobs 14, mounted on an upper portion of each door 13 permit the doors to be easily opened. Base 18 supports turntable 17. The entire assembly of laundry storage 10 is fastened to plate 16 of turntable 17.

In FIG. 2, doors 13 are open, revealing four laundry bags 21. Each bag 21 may be attached at a first end to a door 13 with hook and loop 21A affixed near the top end of each door 13, or by installing two ¾" cup hooks at the top edge of each door (eight, ¾" cup hooks) (not shown). The second end (not shown) may be fastened with hook and loop (VELCRO) or by installing four 1¼" cup hooks (not shown) to the top 11, to grip and suspend the second end. Suspension of bags 21 between the door 13 and top 11 creates a mesh bag 21 for holding and carrying the laundry from the laundry storage 10 to the washing machine.

Brackets 23 are connected between the frame 12 and the doors 13 to hold the doors 13 in an open position when the bags 21 are being removed or replaced. The hinged brackets 23 fold upwardly to close and downwardly to open. Magnetic catches 22 are fastened at the upper ends of doors 13 and a mating part on top 11 to secure the doors 13 in a closed position.

In FIG. 2, doors 13 are opened by releasing magnetic catches 22. When doors 13 are opened, the bags 21 and VELCRO attachments 21A, are revealed. The laundry storage 10 can revolve in the direction of arrows 19 and 20.

Figure 3:
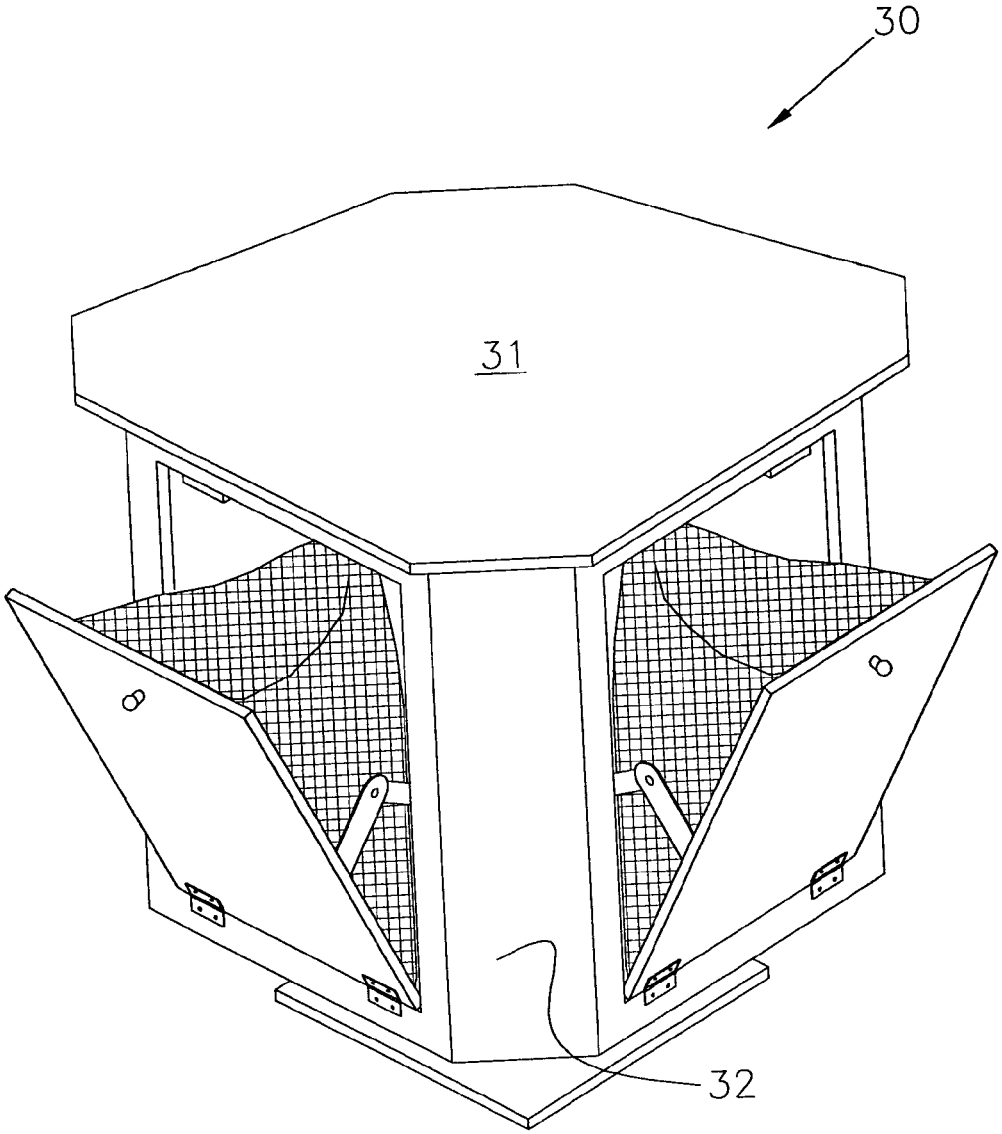
FIG. 3 is a plan view of a second embodiment of the invention having eight sides.

In FIG. 3, a second embodiment of laundry storage 30 is shown. Laundry storage 30 is enlarged by adding four additional spacer panels 32 thereby having eight sides to give added capacity. Top 31 is shaped to accommodate the extra sides. Hinges 15, shown as individual hinges, may also consist of piano hinges (not shown).

The above detailed description is given for explanatory purposes. It will be apparent to those skilled in the art that numerous changes and modifications can be made without departing from the scope of the invention. Accordingly, the whole of the foregoing description is to be construed in an illustrative and not a limitative sense.

What is claimed is:

1. A revolveable laundry hamper for individually storing laundry in a plurality of chambers into which garments and items requiring laundering can be separated according to wash cycle required, said hamper comprising:

a box-like structure having a frame, a top side, four sides, and a bottom side, each of said four sides, having an opening formed therein, a door, comprising a first end, second end, and two side ends, hingedly fastened at the first end to each of said openings in said frame near said bottom side, said door having a first end of a bracket rotatably fastened to an inside surface at each of the two side ends of said door, and having a second end of each bracket rotatably fastened to said frame, said door opening in a downward motion, first fastening means being attached on said inside surface, near a second end of said door, second fastening means being attached to the underside of said top side, said a drawer knob being attached near a second end of said door on the outer surface of said door, magnetic fastening means attached on said inner surface, near a second end of said door, magnetic fastening means attached to the underside of said top side, said fastening means mating and holding said doors in a closed position, a laundry bag being inserted through each of said openings, said laundry bag being removably fastened at a first end to said first fastening means attached on said inner surface of said door, and said laundry bag being fastened at a second end to said second fastening means attached to the underside of said top side, and a turntable being attached to said bottom side of said box-like structure, thereby providing a turning base to access each of said laundry bags.

2. A revolveable laundry hamper of claim 1 wherein said first and second fastening means consist of hook and loop material.

3. A revolveable laundry hamper of claim 1 wherein said first and second fastening means consist of cup hooks.

4. A revolveable laundry hamper of claim 1 wherein said laundry hamper is enlarged by inserting four additional panels, one panel each between pairs of said four sides and said top side is octagonally shaped to accomodate said additional panels.

* * * * *